US010374359B1

(12) United States Patent
Dong et al.

(10) Patent No.: US 10,374,359 B1
(45) Date of Patent: Aug. 6, 2019

(54) PLUG SOCKET ANTI-DISENGAGEMENT DEVICE

(71) Applicants: Kaizheng Dong, Dublin, CA (US); Yuanhui Dong, Dublin, CA (US)

(72) Inventors: Kaizheng Dong, Dublin, CA (US); Yuanhui Dong, Dublin, CA (US)

( * ) Notice: Subject to any disclaimer, the term of this patent is extended or adjusted under 35 U.S.C. 154(b) by 0 days.

(21) Appl. No.: 16/108,995

(22) Filed: Aug. 22, 2018

(30) Foreign Application Priority Data

Apr. 11, 2018 (CN) ..... 2018 3 0145563

(51) Int. Cl.

| | |
|---|---|
| ***H01R 13/639*** | (2006.01) |
| ***H01R 43/26*** | (2006.01) |
| ***H01R 24/28*** | (2011.01) |
| ***H01R 13/502*** | (2006.01) |
| ***H01R 13/627*** | (2006.01) |
| *H01R 13/66* | (2006.01) |

(52) U.S. Cl.
CPC ..... *H01R 13/6392* (2013.01); *H01R 13/502* (2013.01); *H01R 13/627* (2013.01); *H01R 24/28* (2013.01); *H01R 43/26* (2013.01); *H01R 13/665* (2013.01)

(58) Field of Classification Search
CPC ..... H01R 13/6392; H01R 13/502; H01R 13/627; H01R 24/28; H01R 43/26; H01R 13/665; H01R 13/56; H01R 13/5812; H01R 13/595; H01R 35/04
USPC ..... 439/369
See application file for complete search history.

(56) References Cited

U.S. PATENT DOCUMENTS

| | | | | |
|---|---|---|---|---|
| 6,196,865 | B1 * | 3/2001 | Ruffel | H01R 13/56 439/470 |
| 6,419,519 | B1 * | 7/2002 | Young | H01R 13/5812 439/446 |
| 2010/0124837 | A1 * | 5/2010 | Gimenes | H01R 13/5812 439/446 |

* cited by examiner

*Primary Examiner* — Edwin A. Leon
(74) *Attorney, Agent, or Firm* — patent2ip LLC

(57) ABSTRACT

The invention includes an adjustable plug and socket anti-disengagement device, which comprises a bracket body that is able to lock two ends of cords and associated sockets and plugs, such that they cannot be disconnected. This includes wherein the bracket body includes one or more a pull buckles and slide grooves, and slide plates, such that the body can be released and opened to either to unlock and remove or insert and lock two disparate plugs to be connected.

20 Claims, 11 Drawing Sheets

PLUG SOCKET ANTI-DISENGAGEMENT DEVICE

This application claims priority from Chinese Patent 201830145563.9, with filing date of Apr. 11, 2018, entitled Plug Socket Anti-disengagement Device which application is incorporated herein by reference in its entirety for all purposes.

FIELD OF TECHNOLOGY

This disclosure relates generally to electrical plugs and electrical cords. In one example embodiment, to methods, apparatus, and systems to a plug device, in particular to an adjustable plug and socket anti-detachment device for electrical cords and respective plugs.

BACKGROUND

Within many fields electrical cords are plugged together, with a respective plug and socket. This may include the use of device power cords, standalone power cords, extension cords, daisy chain electrical cords, or any other type of cord such as audio/visual cords. Many plugs and sockets are designed, such that they are plugged and unplugged easily by human hands. However, during use and due to human pull, accidents, or other forces, the insertion and extraction force between the plug and the socket is not enough to keep the cords connected. As such, the plugs may be easily detached from the socket, not only causing inconvenience to the user, but also easily causing damage to the devices plugged in, power settings problems or even safety problems. Additionally, with the many different types of cords used in any setting or industry, currently there are no standards for plugs and sockets to have locking mechanisms, as well as it would be cost prohibitive to retroactively replaces legacy power cods with new plugs and receptacles, Thus, there is a need for a device that is able to keep cords together, with their plugs and receptacles, as well as be able to be used with all types of new and legacy cords, receptacles and plugs.

SUMMARY

The present invention provides a locking device that provides an ability to keep disparate plugs with a plug or socket together, even when accidently snagged or pulled. The invention provides a body, with a base and moveable bracket. The base and moveable bracket, through the use of a captive slide, may allow an adjustment depending on the size or length of the plugs, sockets or cords. In some embodiments, this may include the use of tabs and saw teeth, such as to lock the length or adjustments unless manipulated by the user.

The invention then may provide wherein the base and bracket includes channels for the wire or cord to pass through, by the use of tabs or buckles, which when open a wire or cord can be placed in the device, and then wherein the buckles may be closed. The buckles then may secure the cords, or hold, them such that the cord can be locked in the device.

Thus, the invention provides a device that is able to be user configurable to accept a wire or cord with socket or plug in an open configuration, be then closed, and adjust to the size of the plug, socket or cord, and therein when locked may secure the two wires or cords with plugs or sockets together.

The methods and systems disclosed herein may be implemented in any means for achieving various aspects. Other features will be apparent from the accompanying drawings and from the detailed description that follows.

BRIEF DESCRIPTION OF THE DRAWINGS

Example embodiments are illustrated by way of example and are not limited to the figures of the accompanying drawings, in which, like references indicate similar elements.

Figure 1:
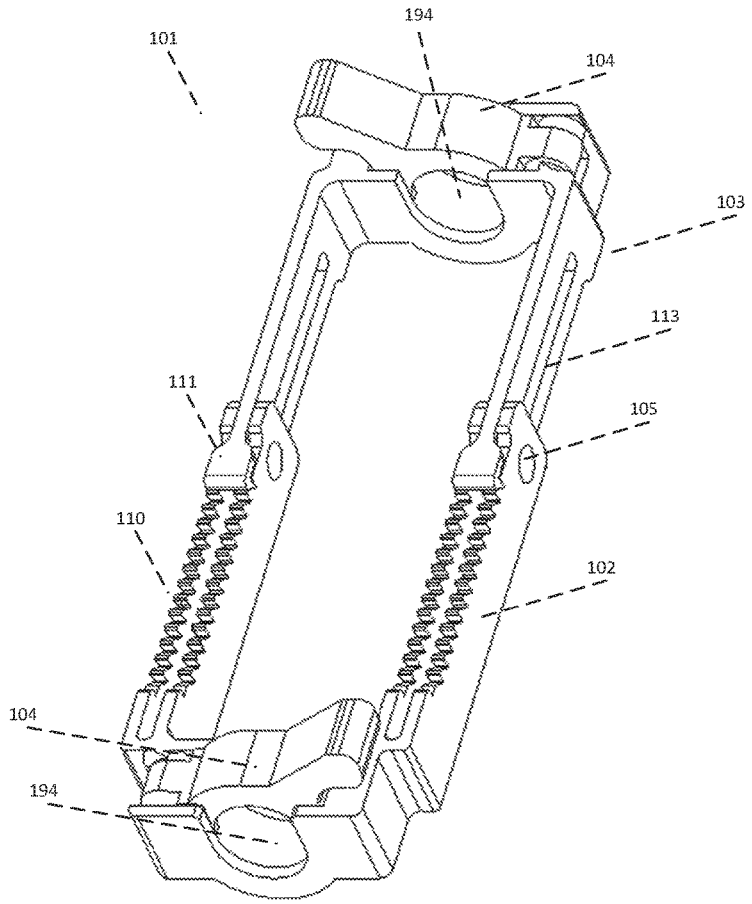
FIG. 1 is a front perspective view of an embodiment of the present invention socket anti-disengagement device.

Other features of the present embodiments will be apparent from the accompanying drawings and from the detailed description that follows.

DETAILED DESCRIPTION

Disclosed are methods, apparatus, and systems that may provide an adjustable plug and socket anti-disengagement device, which comprises a bracket body that is able to lock two ends of cords and associated sockets and plugs, such that they cannot be disconnected. This includes wherein the bracket body includes one or more a pull buckles and slide slots, and slide plates, such that the body can be released and opened to either to unlock and remove or insert and lock two disparate plugs to be connected.

The following is a further description of the utility model with reference to the accompanying drawings and embodiments:

Disclosed are methods, apparatus, and systems that provide a plug device, in particular to an adjustable plug and socket anti-detachment device for electrical cords and respective plugs.

In an embodiment, which may be combined with any other embodiment, an adjustable plug and socket anti-disengagement device, comprises a bracket body.

In an embodiment, which may be combined with any other embodiment, two ends of the bracket body are respectively provided with a pull buckle. The body may be made of two pieces, a base and a movable bracket, wherein on each end of the base and bracket is provided with the pull buckle.

In an embodiment, which may be combined with any other embodiment, therein may be a slide slot on the side of the bracket, such that then with a slide plate, the body includes a slide shaft and pin, wherein may ride the inside of the slide slot, such that the two bracket pieces are able to slide and adjust respective to each other, but also captive by the slide shaft and pin going through the slide slot on the bracket.

In an embodiment, which may be combined with any other embodiment, the main base on the upper side includes a sawtooth ramp, wherein a tab is arranged on the bracket which are matched and locked and connected. Thus, the connection be secured between the plug and the socket, prevent the plug and the socket from disconnecting and facilitate the protection of the electric equipment. The utility model can adjust the distance between the two buckles, and can simultaneously meet different types of plugs and sockets, and the structure is simple. Easy to use, easy to operate, adjustable control, economical and practical, suitable for mass production and wide application.

In an embodiment, which may be combined with any other embodiment, provides an adjustable plug and socket anti-disengagement device wherein the adjustable plug and socket anti-disengagement device includes a bracket body, and two ends of the bracket body are respectively provided with a pull buckle. The bracket body may include a base and a moving bracket, an end of the base and an end of the movable bracket. Both are provided with the pull buckle wherein a sliding slot is disposed at the other end of the base, a sliding plate is disposed at the other end of the moving bracket, and the sliding plate is disposed in the sliding slot In an embodiment, which may be combined with any other embodiment, a top end of the slot may provide with a slide shaft with rod is arranged in the middle of the slot such that the shaft passes through the sliding slot.

In an embodiment, which may be combined with any other embodiment, wherein then may be a sawtooth ramp arranged on the upper part of the base, such that a tab on the bracket engages the teeth. As such then the teeth are able to stop the base and bracket from sliding, unless the tab is manipulated by the used. Further, the rear corner a of the sawtooth ranges from 70° to 90°. Further, the relief angle $\alpha$ of the sawtooth is 80°.

Further, the buckle may include an extrusion, such that a recess in the bracket or base can, with insertion of the extrusion, hold the buckle on pivot point made by the extrusion and recess.

In an embodiment, which may be combined with any other embodiment, a baffle is disposed on the other side of the buckle to lock the buckle close unless manipulated. It is noted that baffle with extrusion may be snap-connected.

In an embodiment, which may be combined with any other embodiment, such that the buckles include a channel, that when the buckle is connected to the body or bracket, a full channel is formed such that forms a wire slot, and the wire slot is a circular arc slot, such that when the buckle is in the closed position the channel allows the passing of a wire or cord.

In an embodiment, which may be combined with any other embodiment, the buckle on the body and the buckle on the bracket may open in different directions or rotations, such that aids in the opening of the buckles to the user.

Further, the chute includes a left sliding plate and a right sliding plate, and the left sliding plate and the right sliding plate are symmetrically disposed on the left and right sides.

Further, the slot includes a left slot and a right slot, and the left slot and the right slot are arranged symmetrically on left and right sides.

The ramp comprises a left ramp and a right ramp. The left ramp and the right ramp are arranged symmetrically in left and right directions. The left ramp is provided with the left tab, and the right ramp is provided with the right tab.

According to the utility model of the above solution, the utility model has the beneficial effects that the utility model can fix the connection between the plug and the socket, prevent the plug and the socket from falling off, and facilitate the protection of the electric equipment. As well, invention can adjust the distance between the two buckles, can meet different types of plugs and sockets at the same time, simple structure, easy to use, easy to operate, adjustable control, economical and practical, suitable for mass production and wide application.

FIG. 1 is a front perspective view of an embodiment of the present invention socket anti-disengagement device.

FIG. 1 shows an adjustable plug and socket anti-unlocking device 101 which includes a bracket body, and two ends of the bracket body which respectively provided with pull buckles 104 respectively. The bracket body two ends are configured with a base 102 and a movable bracket 103. One end of the base 102 and one end of the movable support 103 are provided with pull buckles 104, which are shown to be in a closed position. It is noted that when in a closed position a channel 194 exists, such that a cord could be placed within without damage.

It is shown that the moveable support 103 is provided with a slide slot 113, such that the bracket 103 and 102 base is able to be slid in respect to each other It is noted that there are locking teeth 110 and lock tab 111 which can stop the sliding of the two bases and is aforementioned.

Figure 2:
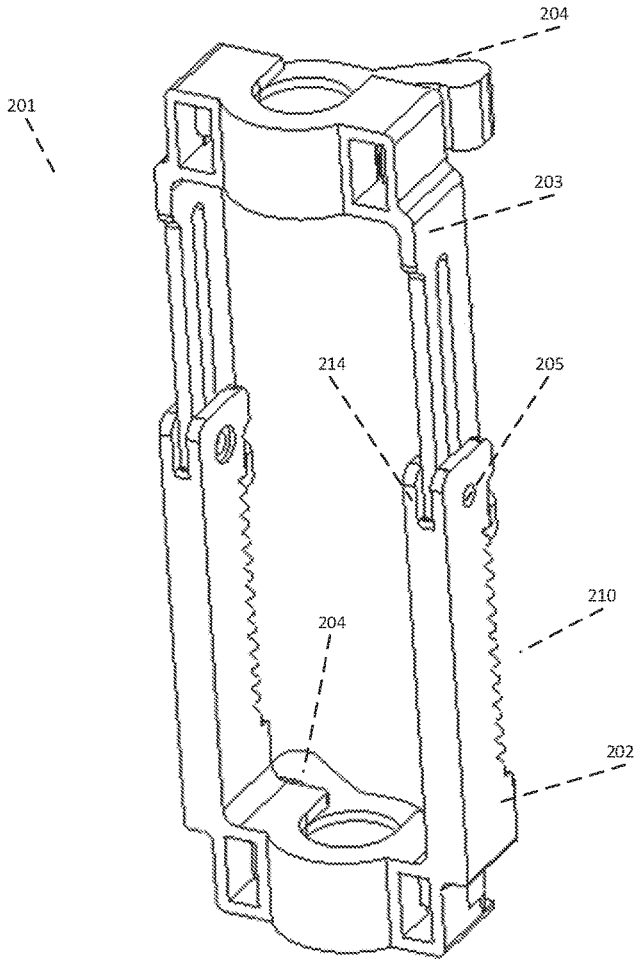
FIG. 2 is a rear perspective view of an embodiment of the present invention socket anti-disengagement device.

FIG. 2 is a rear perspective view of an embodiment of the present invention socket anti-disengagement device.

FIG. 2 shows an adjustable plug and socket anti-unlocking device 201 which includes a bracket body, and two ends of the bracket body which respectively provided with pull buckles 204 respectively. The bracket body two ends are configured with a base 202 and a movable bracket 203. One end of the base 202 and one end of the movable support 203 are provided with pull buckles 204.

A rotation notch 214 is arranged below the connecting shaft and rod 205 for rotating the slide plate to lock and unlock the slide plate. The preferred connecting shaft 205 may be a rivet or a pin shaft. It is noted that the slot left slot plate and a right slot plate, and the left slot plate and the right slot plate may be symmetrically disposed on left and right sides.

Figure 3:
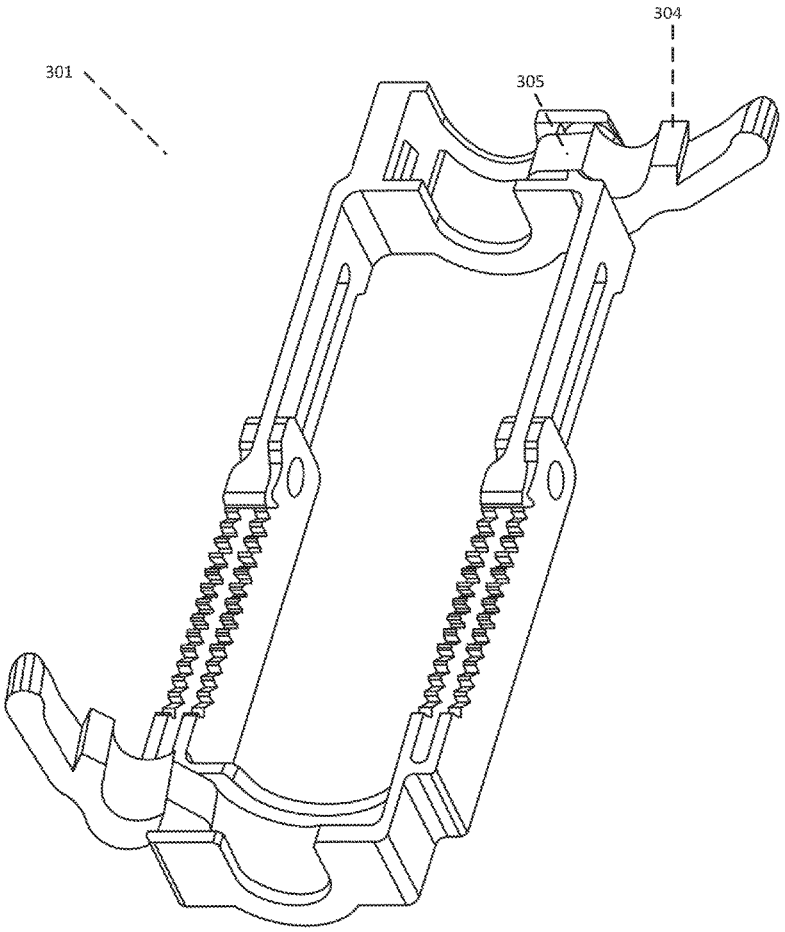
FIG. 3 is a front perspective view of an embodiment of the present invention socket anti-disengagement device with the buckles in an open position.

FIG. 3 is a front perspective view of an embodiment of the present invention socket anti-disengagement device with the buckles in an open position.

FIG. 3 shows a similar view of the device from that of FIG. 1, wherein the device 301 is configured with the pull buckles 304 in the open position, such that a cord or cords can be placed in the device. It is noted that the buckles can pivot around a pivot point or hinge 305.

Figure 4:
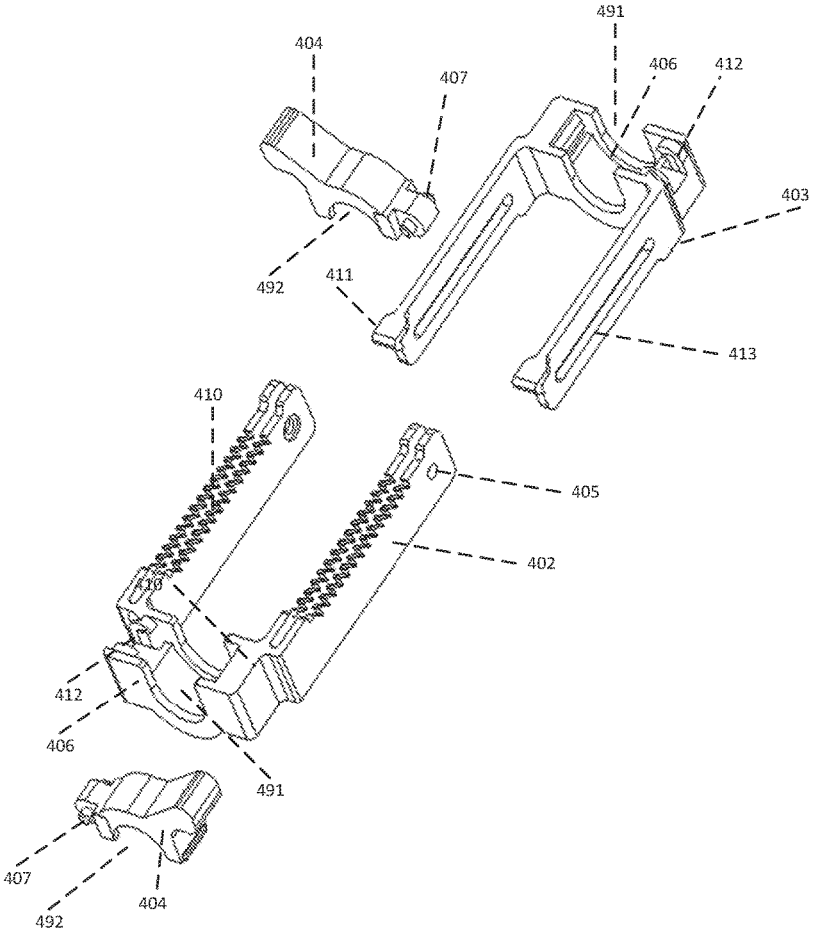
FIG. 4 is a front blown up perspective view of an embodiment of the present invention socket anti-disengagement device.

FIG. 4 is a front blown up perspective view of an embodiment of the present invention socket anti-disengagement device.

FIG. 4 shows that the device 401 can be dissembled into disparate parts for assembly or for servicing, wherein exists at least a body 402, a support 403, and buckles 404, all of which may interlock with or without other hardware, for instance because each piece includes molded or other locking or friction fit extrusions or recesses.

It is noted that the support 403 is provided with a slide plate with slide slot 413, such that a connecting shaft and rod 405 is arranged wherein the connecting rod 405 is through the connecting shaft and also the slide slot, 413 wherein the connecting rod 405 passes through the sliding slot such that the two body pieces, the support 403 and body 402 are able to slide and adjust in length. Therein then is a sawtooth ramp 410 is arranged at the upper part of the base body when the two bodies are connected via the slot and connecting shaft rod such that the locking tab 411 on the support is matched with the teeth, wherein the matching of the tab and teeth lock the bodies rigid from sliding unless a user manipulates them.

The pull buckle 404 includes a recess 406, wherein the buckles 404 can be inserted. A side of the buckle 404 is provided with an extrusion 407, which may be placed in a recess 412, such that a pivot point is created in the recess 406, such that the buckle is able to pivot. The recess 406 is provided on the other side with a baffle, and the buckle 404 is another. Therein the buckle 404 and recess 406 are provided wherein are snap-connected, and are detachably connected through the extrusion and recess 407 and 412 to facilitate assembly and disassembly.

It is shown that the body and support pieces 403 and 402, along with buckles 404 are provided with a channel 491 and 492 respectively, that when assembled and in a closed position, configured to a single channel such that a cord could be placed to prevent damage to the live wire. With the buckle 404 rotating through the recess 406, the channel still exists such that the cable is able to be held but not damage. It is noted that the exterior of the channel 491 and 492 formed together may or may not touch the wire, or at least where the wire is loose. In other embodiments, the channel compresses the wire and holds the wire by friction without damage.

It is noted that the pull buckle 404 may be mirrored, such that the base 402 includes a first pull buckle and support 403 includes a second pull buckle. The direction of the opening and closing of the buckle on each respective base 402 and support 403 may be in opposite direction wherein this arrangement is advantageous for the force when the buckle is opened or closed.

Figure 5:
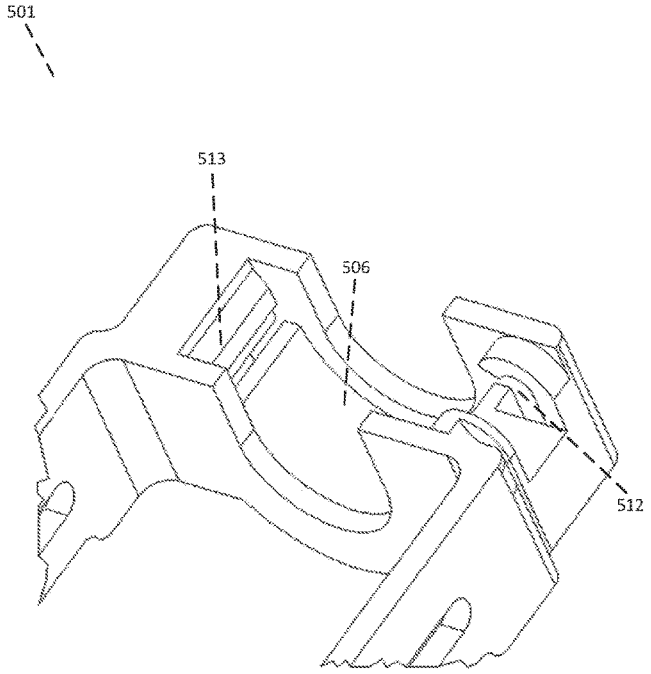
FIG. 5 is zoomed detailed view of an embodiment of the present invention socket anti-disengagement device.

FIG. 5 is zoomed detailed view of an embodiment of the present invention socket anti-disengagement device.

FIG. 5 shows a zoomed in view of the recess and baffle on the body as discussed in FIG. 4. FIG. 5 cutaway 501 shows the recess 506, wherein the buckle would be inserted, wherein the buckle extrusion not pictured (the same as extrusion 407 in FIG. 4) would enter into recess 512, such that the buckle could pivot and such that the buckle is able to be manipulated to an open or closed position. This may be wherein then buckle is able to be snapped in and out of the recess, such that it is easily assembled and disassembled, but also wherein the buckle is secure in the recess. Also, there may be a baffle or other extrusion, such as baffle 513 wherein allows the buckle to be frictioned or locked such as providing positive pressure to the buckle such that the mechanism is locked closed until manipulated by a user. It is noted that therein may also be an extrusion which may lock through friction the buckle in the open position.

Figure 6:
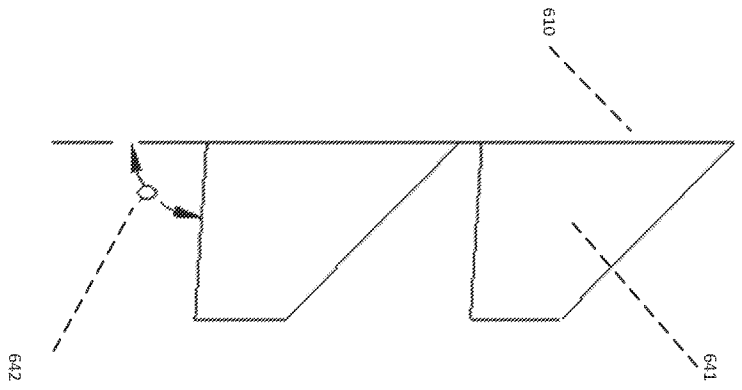
FIG. 6 is detailed cross section of an embodiment of the present invention socket anti-disengagement device.

FIG. 6 is detailed cross section of an embodiment of the present invention socket anti-disengagement device.

FIG. 6 shows the saw teeth similar to that in FIG. 4, wherein a close up 610 of the saw teeth, with includes teeth 641, include a backlash angle $\alpha$ 642 of the saw tooth ranges from 70° to 90°. Preferably, the rear corner a of the saw tooth is 80°.

The chute includes a left chute 6 and a right chute 5, the left chute 6 and the right chute 5 are symmetrically disposed on two sides, the skateboard includes a left skateboard and a right skateboard, the left skateboard and the left skateboard The right slide plate is symmetrically arranged left and right, the left slide plate is provided with the left slide plate, and the right slide plate is provided with the right slide plate.

The utility model moves the bracket in the base to realize the distance between the two buckles, so as to adapt to different types of plugs and sockets, wherein through the lock between the saw teeth on the slide slot and the tab is able to be adjusted and locked such as to achieve a fixed limit between the two buckles.

Figure 7:
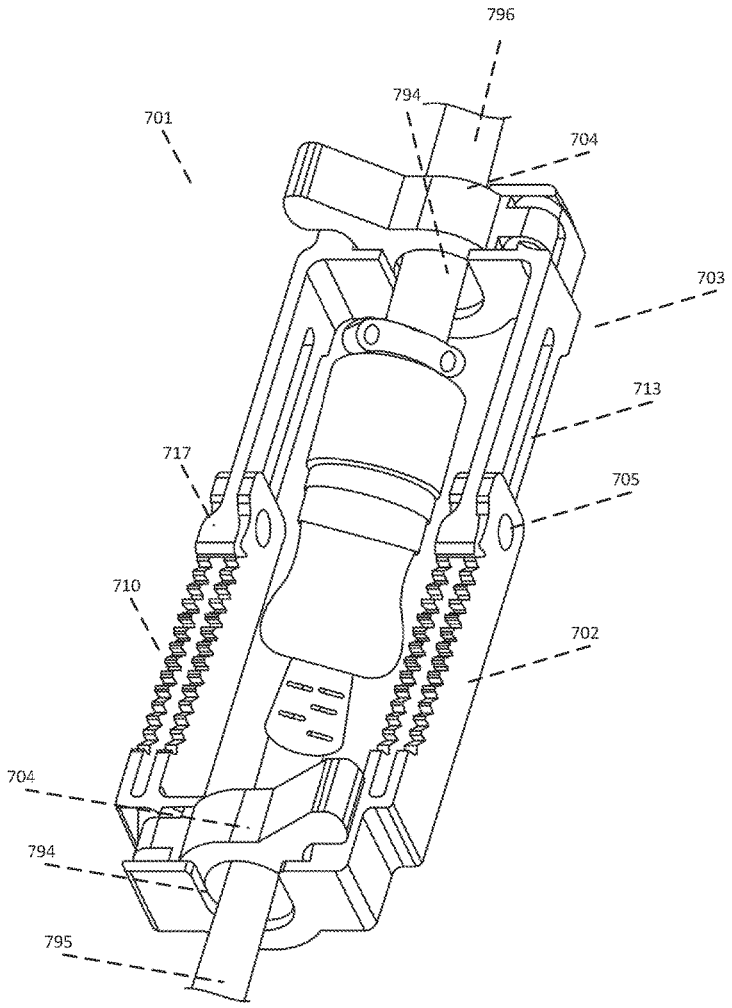
FIG. 7 is a front perspective view of an embodiment of the present invention socket anti-disengagement device with plugs.

FIG. 7 is a front perspective view of an embodiment of the present invention socket anti-disengagement device with plugs.

FIG. 7 shows an adjustable plug and socket anti-unlocking device 701 which includes a bracket body, and two ends of the bracket body which respectively provided with pull buckles 704 respectively. The bracket body two ends are configured with a base 702 and a movable bracket 703. One end of the base 702 and one end of the movable support 703 are provided with pull buckles 704, which are shown to be in a closed position. It is noted that when in a closed position a channel 794 exists, such that a cord with socket or plug 795 and 796 are placed within without damage, such that the cord is held inside the device, wherein the cords 795 and 795 stay plugged together.

It is shown that the moveable support 703 is provided with a slide slot 713, such that the bracket 703 and 702 base is able to be slid in respect to each other It is noted that there are locking teeth 710 and lock tab 711 which can stop the sliding of the two bases and is aforementioned.

Figure 8:
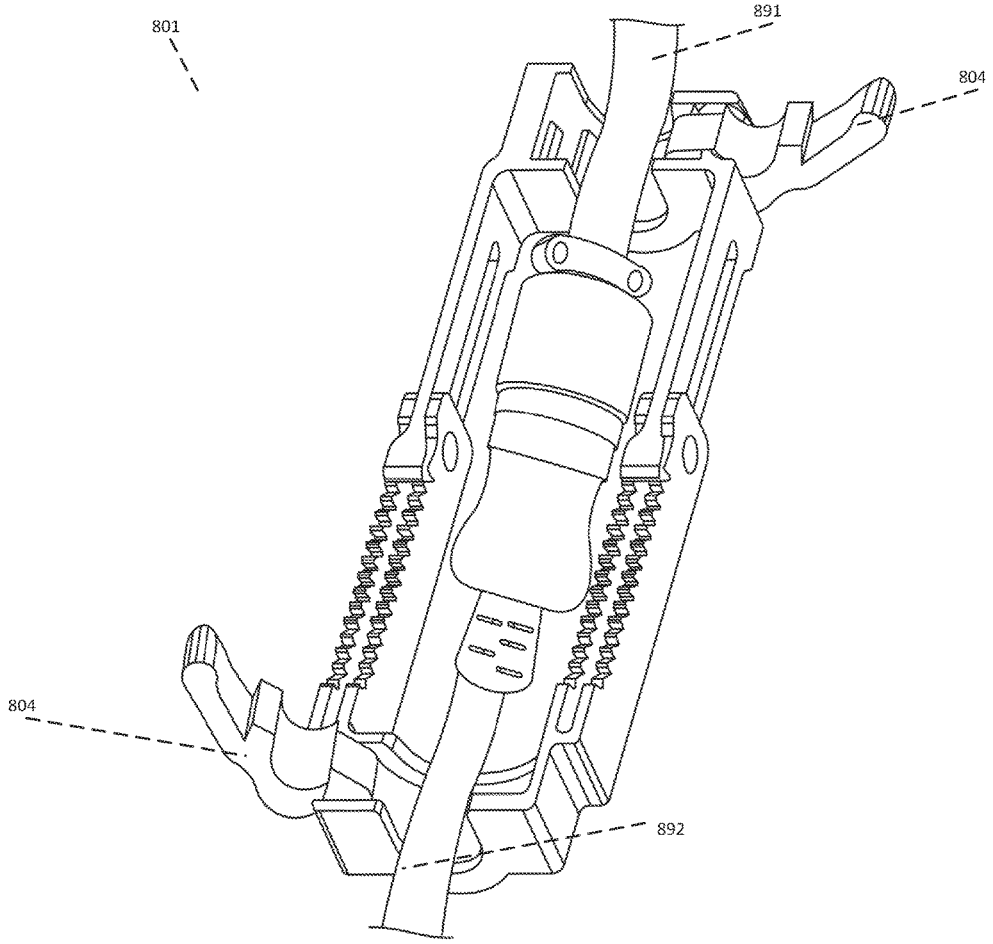
FIG. 8 is a front perspective view of an embodiment of the present invention socket anti-disengagement device with plugs and the buckles in an open position.

FIG. 8 is a front perspective view of an embodiment of the present invention socket anti-disengagement device with plugs and the buckles in an open position.

FIG. 8 is the same view as FIG. 7, but instead with the buckles 804 in the option position such that the cord with socket or plug 891 and 892 may be opened to be removed from device 801.

The working principle of the utility model is to use the wrenches at both ends of the device to place the wires connected to the plug and socket in the device, and use the hooks and the serrations on both sides of the device to fix the plug and the socket in the device and close the pull buckle. In this case, the wires cannot be disassembled or pulled in any way during the use, so that the plugs and sockets cannot be separated, which facilitates the use and ensures safety.

The utility model has the advantages of simple design, easy use, and can be used together with most of the power supply extension lines, including the 1-15, 5-15, 6-15, 5-20, 6-20 and other models in the U.S. This includes NEMA connectors. The inserted plug and socket can also cover some European standard plug sockets. Based on this simple design, the manufacturing cost of the utility model is also very low, and it can be widely used in the case of any mobile plugs and sockets, so as to ensure that the power extension line will not be disconnected during the normal use process, so as to avoid causing power supply equipment to be damaged or malfunction.

Since the power extension line is a very common product in the United States, most of it is used in mobile applications. If the device is used in conjunction with a power extension line, the market sales prospects will be very wide.

The utility model can fix the connection between the plug and the socket, prevent the plug and the socket from falling off, and facilitate the protection of the electric equipment. The utility model can adjust the distance between the two buckles, and can simultaneously meet different types of plugs and sockets, and the structure is simple. Easy to use, easy to operate, adjustable control, economical and practical, suitable for mass production and wide application.

Figure 9A:
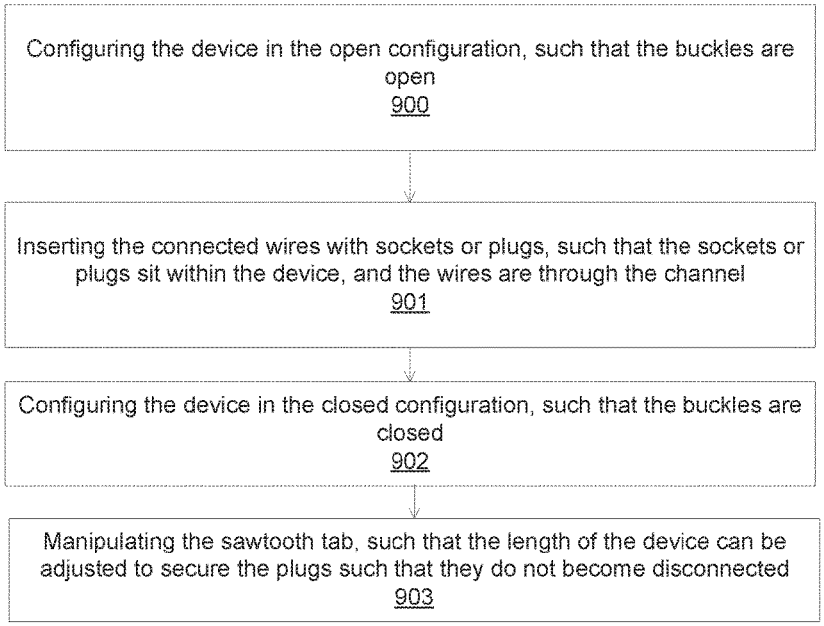
FIGS. 9A and 9B are process diagrams of manipulating the device for use with a wire with socket or plug.
Figure 9B:
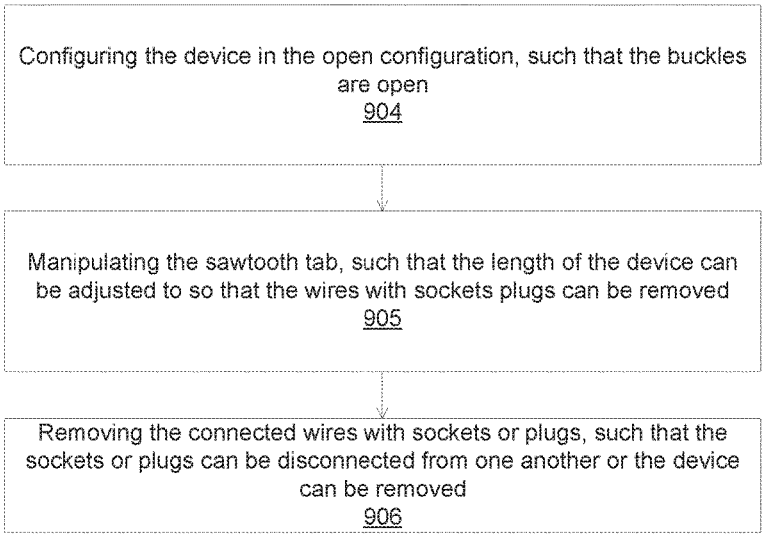

FIGS. 9A and 9B are process diagrams of manipulating the device for use with a wire with socket or plug.

FIG. 9A describes at least process 900, wherein configuring the device in the open configuration, such that the buckles are open; process 901 wherein inserting the connected wires with sockets or plugs, such that the sockets or plugs sit within the device, and the wires are through the channel; process 902 wherein configuring the device in the closed configuration, such that the buckles are closed; and process 903 wherein manipulating the sawtooth tab, such that the length of the device can be adjusted to secure the plugs such that they do not become disconnected FIG. 9B describes at least process 904, wherein configuring the device in the open configuration, such that the buckles are open; process 905 wherein manipulating the sawtooth tab, such that the length of the device can be adjusted to so that the wires with sockets plugs can be removed; and process 906 wherein Removing the connected wires with sockets or plugs, such that the sockets or plugs can be disconnected from one another or the device can be removed.

It is noted that the processes in FIGS. 9A and 9B as well as throughout this disclosure can be made in any order. For instance process 905 may be made before or after configuring the device in the open configuration, such as the ease the manipulation ability by the user to length or extend the device, or because manipulating the length is easier when the wire with plug or socket is easier, for instance.

Figure 10:
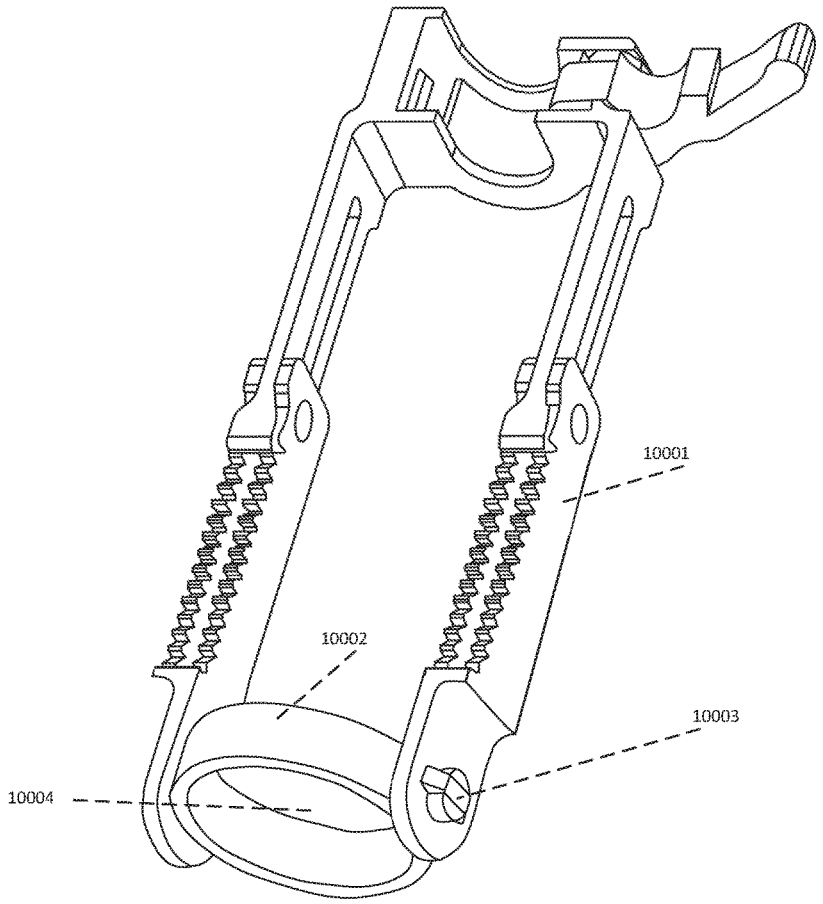
FIG. 10 is a perspective view of an embodiment of the present invention socket anti-disengagement device with alternative embodiment of a socket or plug holder.

FIG. 10 is a perspective view of an embodiment of the present invention socket anti-disengagement device with alternative embodiment of a socket or plug holder.

FIG. 10 depicts a present invention socket or plug holder 10001 as previously described, but in an alternative embodiment, wherein one end, such as on the bottom end, wherein there includes a ring 10002, of which may hold a socket or plug. It is noted that is some embodiments the ring 10002 may be separate from the socket or plug, or in others may be integral to the socket or plug held. The ring may include tabs 10003 which may pass through the structure of the holder 10001, such that the ring is captive to the structure of the holder 10001. A socket or plug may then be held in the volume 10004 within in the ring 10002, wherein the ring may interlock or be held captive by the ring, such as wherein the ring may interlock with a circumferential groove in the socket or plug to be held. It is noted that the tabs 10003 may be of any type, and may allow the ring and the plug being held to pivot, as well as the ring can be integral or removal to the plug, such as a friction or snap fit, among other fastening.

Figure 11:
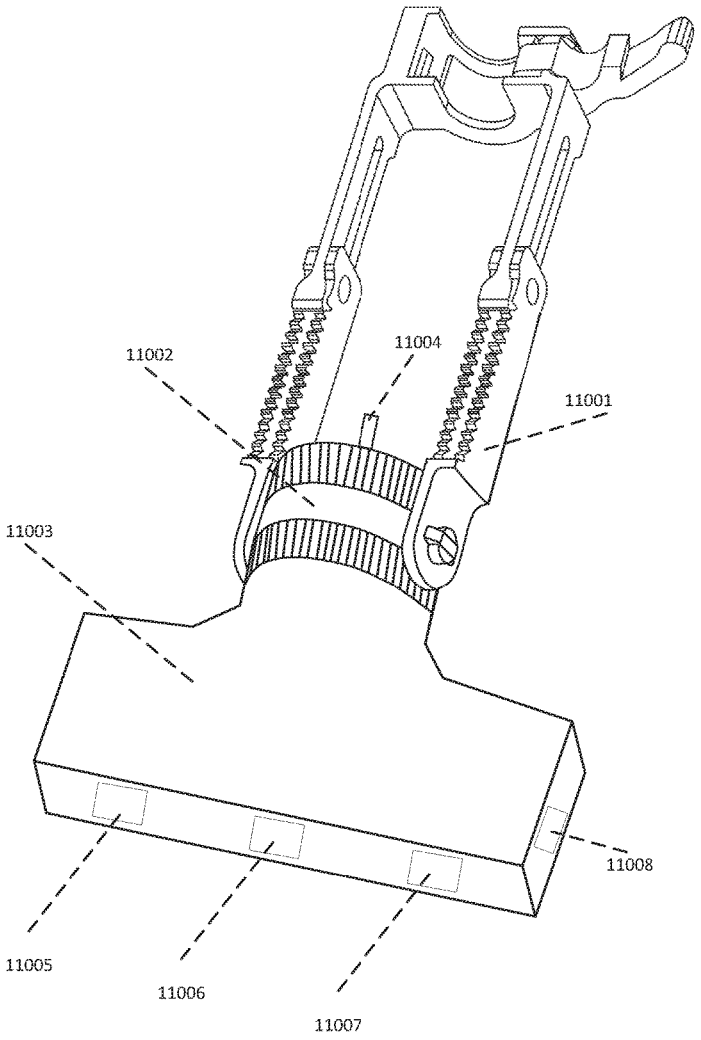
FIG. 11 is a perspective view of an embodiment of the present invention socket anti-disengagement device with alternative embodiment of a socket or plug holder.

FIG. 11 is a perspective view of an embodiment of the present invention socket anti-disengagement device with alternative embodiment of a plug holder.

FIG. 11 depicts a present invention socket or plug holder 11001 as previously described, and is similar to the embodiment in FIG. 11, but now with a plug or socket 11003 inserted in the ring 11002. It is noted that the socket or plug 11003 may have a female or male end 11004, to be connected to a socket or plug held in the opposite side of the holder. It is noted that the socket or plug 11003 may have one or more inputs and outputs such as 11004, 11005, 11006, 11007, and 11008 of which may be any plurality, type, style or location. It is noted, that such as with input and output 11008, the input and output can be on any location or side of the socket or plug 11103, and may be of any design, structure or geometry. Additionally, the plug or socket 11003, may have other features such as a fuse, power disconnect switch, light, or any other structure or feature. It is noted, as is similar to FIG. 10, that the socket or plug holder 11001 may have wherein one end, such as on the bottom end, wherein there includes a ring 11002, of which may hold a socket or plug. It is noted that is some embodiments the ring 11002 may be separate from the socket or plug, or in others may be integral to the socket or plug held. The ring may be captive to the structure of the holder 11001. A plug or socket 11003 may then be held in the volume within in the ring 11002, wherein the ring may interlock or be held captive by the ring, such as wherein the ring may interlock with a circumferential groove in the plug to be held.

It should be understood that those skilled in the art can make improvements or changes based on the above description, and all of these improvements and changes should fall within the protection scope of the appended claims of the present invention.

The invention has been described above with reference to the accompanying drawings. It is obvious that the implementation of the patent of the utility model is not limited by the above methods, as long as various improvements made by the method idea and technical solution of the utility model patent are adopted, or Without improvement, the concept and technical solution of the utility model patent are directly applied to other occasions, and all are within the protection scope of the utility model.

Although the present embodiments have been described with reference to specific example embodiments, it will be evident that various modifications and changes may be made to these embodiments without departing from the broader spirit and scope of the various embodiments. It should be understood by one of ordinary skill in the art that the terms describing processes, products, elements, or methods are industry terms and may refer to similar alternatives In addition, the components shown in the figures, their connections, couples, and relationships, and their functions, are meant to be exemplary only, and are not meant to limit the embodiments described herein.

A number of embodiments have been described. Nevertheless, it will be understood that various modifications may be made without departing from the spirit and scope of the claimed invention. In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

It may be appreciated that the various systems, methods, and apparatus disclosed herein may be embodied in a machine-readable medium and/or a machine accessible medium compatible with a data processing system (e.g., a computer system), and/or may be performed in any order.

The structures and modules in the figures may be shown as distinct and communicating with only a few specific structures and not others. The structures may be merged with each other, may perform overlapping functions, and may communicate with other structures not shown to be connected in the figures. Accordingly, the specification and/or drawings may be regarded in an illustrative rather than a restrictive sense.

What is claimed is:

1. An adjustable plug and socket anti-unlocking device, comprising:

a body, wherein the body is made of at least a base and bracket coupled together, wherein:

the base is configurable with:

a base buckle at a first end of the body, wherein the base buckle pivots at a pivot point in the base, one or more slide shafts and slide pins, wherein the slide pins are inserted through the slide shafts and are held captive;

the bracket is configurable with:

a bracket buckle at a second end of the body, opposite to the first end, wherein the bracket buckle pivots at a pivot point in the bracket, one or more slide slots, wherein the slide pins, inserted into the slide shafts in the base, are configured to pass through the one or more slide slots in the bracket, such that the bracket can slide up and down respective to the base and are held captive by the slide pins and respective slots;

an open space interior of the body, wherein two wires or cords with respective plug or socket are able to be held.

2. A device as in claim 1, wherein the base and bracket buckle are able to be pivoted via the pivot point to be in an open or closed configuration.

3. A device as in claim 2, wherein the open configuration allows the two wires or cords with respective plug or socket are able to be inserted or removed.

4. A device as in claim 2, wherein the closed configuration disallows the two wires or cords with respective plug or socket to be disconnected such as from a yank or pull.

5. A device as in claim 1, wherein the bracket is configured to be adjusted via the one or more slide slots, shafts and pins such that the distance of the open space interior of the device fits the two cords or wires with a respective plug or socket to be held.

6. A device as in claim 1, wherein the base includes one or more ramps with saw teeth, wherein one or more tabs on the bracket are configured to interact with the saw teeth.

7. A device as in claim 6, wherein the length of the body, made of at least the base and bracket is adjusted via sliding the bracket, which is held captive to the base by the one or more slide pins via the slide shafts and wherein then the ramp saw teeth and tabs lock the length in place.

8. A device as in claim 7, wherein wherein the one or more tabs are configured to be manipulated by a user to unlock from the teeth.

9. A device as in claim 6, wherein wherein the saw teeth have a clearance angle $\alpha$ ranging from 70° to 90°.

10. A device as in claim 6, wherein wherein the saw teeth have a receding angle $\alpha$ is 80°.

11. A device as in claim 1, wherein the base buckle and bracket buckle include a buckle recess respectively, wherein the buckle recess is where the pivot point is configured the buckle includes two pivot extrusions, such that the extrusions fit in a pivot recess in the buckle recess on the respective body or bracket, such that each buckle can be removably connected to a respective bracket or body via the extrusions and recess.

12. A device as in claim 1, wherein the base and bracket buckle pivot range of motion is limited by the buckle recess, but wherein the buckles are able to be configured to close completely and open completely, such that a wire and cord are able to be inserted and removed from the device.

13. A device as in claim 1, wherein the base and bracket buckle includes two pivot extrusions, such that the extrusions fit in a pivot recess on the respective body or bracket, such that each buckle can be removably connected to a respective bracket or body via a pivot.

14. A device as in claim 1, wherein the base and bracket buckles are removable via a press fit.

15. A device as in claim 1, wherein the base and the bracket each include a crescent shaped open recess at each long end opposite each other when connected;

the base buckle and the bracket buckle each include a crescent shaped open recess, such that when the buckles are connected to the respective base or body, and when the buckles are in a closed position, the crescent open recesses form a channel for the wire or cord to be held, such that the wire or cord does not get damaged.

16. A device as in claim 1, wherein the base and bracket buckles pivot in opposite directions such that the user is able to easily open the buckles.

17. A device as in claim 1, wherein configured on the base below the slide shafts and pins is a rotation notch, wherein the rotation notch aids in inserting and connecting the base and the bracket together via the sliding shaft, pin and slot, such that the bracket can be rotated in the range allowed by the notch.

18. A device as in claim 1, wherein the base and the bracket are symmetrical wherein the respective one or more sliding shafts, pins, slots and notch are symmetrical, such that the base and the bracket when viewed from the top or bottom include on each symmetrical side a matching slot, shaft pin and notch, such that between the symmetrical sides is the open space interior of the body.

19. A device as in claim 6, wherein the base and the bracket are symmetrical wherein the respective saw teeth ramps and tabs are symmetrical, such when viewed from the top or bottom include on each symmetrical side the saw teeth ramp and tab, such that between the symmetrical sides is the open space interior of the body.

20. A device as in claim 1, wherein the wires or cords with plug or socket is a standard NEMA connector.

* * * * *